US007090099B2

(12) United States Patent
Urich et al.

(10) Patent No.: US 7,090,099 B2
(45) Date of Patent: Aug. 15, 2006

(54) METHOD AND DEVICE FOR IRONING GARMENTS

(76) Inventors: Bodo Urich, Filehner Str. 67, Berlin (DE) 12555; Kristina Knispel, Landsberger Allee 180, Berlin (DE) 10369; Kathrin Redlin, Haeselerstr. 17k, Berlin (DE) 14050; Christian Hafer, Taubensteinweg 8, Erding (DE) 85435; Joachim Damrath, Raiffeisenstr. 7, Bachhagel (DE) 89429; Gerhard Wetzl, Hohweiherstr. 15, Sontheim (DE) 89567; Markus Spielmannleitner, Rosenberger Str. 49, Ellwangen (DE) 73479; Sebastian Siegele, Cuvrystr. 25, Berlin (DE) 10997

( * ) Notice: Subject to any disclaimer, the term of this patent is extended or adjusted under 35 U.S.C. 154(b) by 169 days.

(21) Appl. No.: 10/441,653

(22) Filed: May 19, 2003

(65) Prior Publication Data

US 2004/0065701 A1 Apr. 8, 2004

Related U.S. Application Data

(63) Continuation of application No. PCT/EP01/13555, filed on Nov. 21, 2001.

(30) Foreign Application Priority Data

Nov. 24, 2000 (DE) ..... 100 58 403

(51) Int. Cl.
*A41H 5/02* (2006.01)

(52) U.S. Cl. ..... 223/67

(58) Field of Classification Search ..... 223/67, 223/66, 69, 70

See application file for complete search history.

(56) References Cited

U.S. PATENT DOCUMENTS

| | | | | |
|---|---|---|---|---|
| 2,513,427 A | | 7/1950 | Hanson et al. | |
| 2,720,347 A | * | 10/1955 | Jackson | 223/67 |
| 2,990,983 A | | 7/1961 | Jackson | |
| 3,315,853 A | | 4/1967 | Blevens et al. | |
| 3,326,427 A | * | 6/1967 | Schlemon | 223/67 |
| 3,568,900 A | * | 3/1971 | Paris | 223/70 |
| 6,142,965 A | * | 11/2000 | Mathewson | 602/62 |

* cited by examiner

*Primary Examiner*—Gary L. Welch

(57) ABSTRACT

A method and a device for ironing garments using a form finisher, which has an inflatable bag over which the garments are placed. The bag includes a bottom construction and a tension device between the bottom construction and the inflatable bag. The tension device being one of an inflatable cushion and a tension cable, with the tension device providing vertical tension to the bag.

20 Claims, 2 Drawing Sheets

METHOD AND DEVICE FOR IRONING GARMENTS

Figure 1:
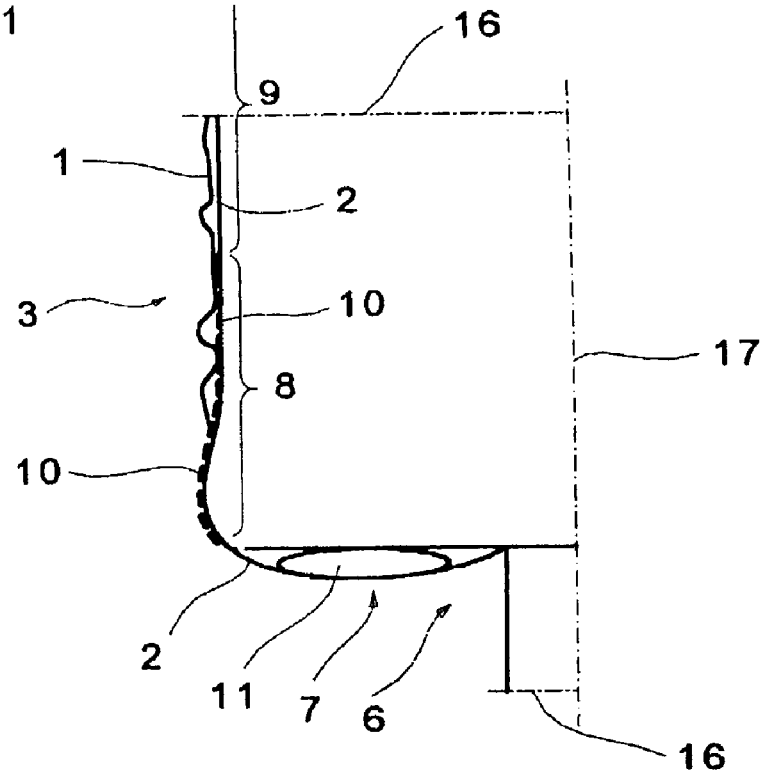

This invention relates to a method and a device for ironing garments according to the preambles of Claims 1 and 2.

Devices for ironing items of clothing are known in the state of the art in a variety of forms. One professional method of ironing items of clothing which is widely used is to use a finisher in ironing. Such finishers consist of a stand with an inflatable bag arranged above it. The inflatable bag may be impermeable to air and then serves only as a tension element for the garment to be dried, or the inflatable bag may also be designed to be air-permeable, in which case the stream of air inflating the air bag is also at the same time drying the garment. In the latter case, the inflatable bag is often designed to be air-impermeable in the neck area of the garment. If the inflatable bag is designed to be air-impermeable, drying of the clothing item is accomplished by a stream of drying air which is applied from the outside. In some cases these finishers also have inflatable arms. The clothing items—in particular shirts, blouses, T-shirts and jackets—are pulled onto the inflatable bag of the finisher while the clothing items are still damp and then they are secured there detachably on the inflatable bag by means of securing aids. These securing aids have the function of orienting the garment on the inflatable bag with no wrinkles if possible and sealing any open locations in the garment such as button strips so that the dry air cannot escape from unbuttoned garments. When ironing T-shirts, the securing aids are not absolutely necessary. In this case the garment is merely aligned.

For example, U.S. Pat. No. 3,568,900 is a publication known from the state of the art. In this case, an inflatable bag is arranged on a basic framework in the bottom area. A bottom construction, which allows air to flow into the finisher and at the same time secures the inflatable bag, is inserted into the basic framework. This device is provided for ironing shirts. The open arms of the shirt are each closed with the help of a cuff clamp and smoothed. The collar area is also closed by special use of an inflatable bag and the button strips are sealed by means of a flat-area pressing element. Since shirts of course also have an opening at the bottom and the stream of air escaping from the inflatable bag could lift the shirt upward, spring-loaded holders are also attached to the shirt to be ironed with this state of the art. These holders secure the shirt by means of clamps on the bottom hem of the shirt and are also attached to the bottom construction of the finisher. This has the disadvantage that the operating person must attach these clamps to the hem of the shirt separately with each individual shirt and then must remove them again when the shirt is completely ironed. This requires a considerable amount of time and thus also increases the ironing costs.

The length of an inflatable bag is coordinated with the longest shirt to be expected. Therefore the known clamps are also required at the lower hem of a shirt because in the case of a shorter shirt the inflatable bag of a finisher will be inflated more beneath the hem of the shirt than would correspond to the dimension of the taut shirt because the shirt limits the expansion of the inflatable bag. This bulge in the inflatable bag beneath the hem has the effect that the shirt is shifted upward on the inflatable bag. Then in ironing this results in the so-called ironing waves, especially in the side seam area, which could also be referred to as a washing board pattern to some extent.

Therefore the object of the present invention is to discover a finisher of the type defined in the preamble that will prevent or at least reduce these disadvantages.

According to this invention this object is achieved by the features of the characterizing part specified in Patent claims 1 and 2. Advantageous embodiments and refinements of this invention are derived from the subclaims.

The inventors have recognized that when using a finisher in ironing, the bulge which develops beneath a shirt (or blouse, T-shirt or jacket, hereinafter referred to only as a garment or item of clothing) can be eliminated by applying vertical tension to the inflatable bag. The vertical tension on the inflatable bag is advantageously applied in the lower area of the inflatable bag because this is where the bulge always develops. In addition, no usable surface area of the inflatable bag is lost by applying tension in the lower area. Furthermore due to this vertical tension there is no longer the risk of clothing items slipping up and thus ironing waves are also prevented. Since the inflatable bag is pulled downward rather than pulling the garment itself downward as in the state of the art, this eliminates the attachment and removal of clamps with each separate garment when ironing a garment. Therefore the ironing operation and changing of garments on the finisher can be shortened considerably. Due to this vertical tension on the inflatable bag, the area of the finisher which is not covered by the clothing item is in the same shape as the inflatable bag beneath the garment.

In the case of the finisher according to this invention, at least one tension device is provided in the lower area of the inflatable bag and is connected to the bottom construction of the finisher. This has the advantage that the tension forces can be introduced by the shortest pathway into fixed components of the finisher. The bottom construction may have a simple base or a complete supply unit in which the stream of dry air is created. This supply unit then also serves as the substructure/stand for the inflatable bag.

For example, if clamps are used as the tension device, then several clamps must be arranged in the most uniform possible distribution around the circumference of the lower end of the inflatable bag so that the same vertical tension is created for all sectors of the inflatable bag. In combination with other tension devices—to be explained below—it is also possible to accomplish the vertical tension using only one single tension device.

It is especially advantageous if the outside surface of the inflatable bag—preferably only in its lower area—is equipped with a high coefficient of friction than the other surface. This lower area then extends from approximately above the lower hem of the shortest possible garment to the lower end of the inflatable bag. The length of the inflatable bag is in turn determined by the length of the longest possible item of clothing. Due to the higher coefficient of friction, the fabric of the garment adheres better in this lower area. Once the garment has been placed on the inflatable bag and aligned and the stream of air has been activated and the inflatable bag is also under vertical tension, the fabric of the garment is also under vertical tension because the lower area of the inflatable bag entrains this fabric. Therefore, no ironing waves can be formed in ironing.

It has been found that only the lower fourth of the inflatable bag—based on its total length—need be equipped with this higher coefficient of friction to nevertheless be able to apply vertical tension to the variety of possible garments.

In addition it is advantageous if this lower area having the higher coefficient of friction is applied to the surface of the inflatable bag in only a spot. Therefore, the frictional force applying tension to the garment can be dimensioned in a controlled manner without requiring an unnecessarily great amount of area to be used for the higher coefficient of friction. In addition, an unnecessarily great use of these areas would unnecessarily restrict the air permeability of the inflatable bag, which might be a desirable feature.

This higher coefficient of friction can be implemented for example by rubberizing the outside surface of the inflatable bag. This rubberizing may be implemented in such a way that it is either incorporated into the material of the inflatable bag or is applied to the surface.

Another possibility of achieving a higher coefficient of friction is given by applying a chemical adhesive. The inflatable bag may be finished with this chemical adhesive at the time of production or this may be accomplished by a subsequent spraying as needed.

To achieve a higher coefficient of friction, however, the surface of the inflatable bag may also be provided with a structure having a higher coefficient of friction. This surface can be achieved by either roughening the material of the inflatable bag in a controlled and directional manner or by applying a material in the form of strips in particular to the surface of the inflatable bag, where this material has a higher coefficient of friction, e.g., rubberized fabric strips or Velcro-type strips.

All of these measures to increase the coefficient of friction may be used individually, i.e., exclusively or in any combination.

A refinement of the mechanical tension device is its implementation as a pneumatic operating element. If an inflatable air cushion is used, for example, it can generate forces—namely compressive forces—only in the inflated state.

In order for these forces to be converted to tension forces, a special arrangement is needed. For example if the inflatable bag is "flanged" to the inside to a certain extent at its lower end and if it is in contact here with the bottom structure, a tension can be created by inflating the air cushion in the case when an air cushion is provided between the point of contact of the latter and the unflanged area.

The inflatable air cushion may be designed in the form of a ring. Another design of the pneumatic tension device, however, may also be implemented structurally by arranging a plurality of air cushions in the form of a ring in the area of the bottom construction. In addition, a mechanical spreading element is also conceivable, this being arranged between the flanged area and the bottom construction and pressing the flanged area downward.

However, the inflatable bag may also be put under vertical tension by means of a tension cable. To do so, again the lower edge of the inflatable bag must have an inward flange. A tension cable, which is arranged in a star pattern between the eyelets of the lower end of the inflatable bag and eyelets of the bottom construction, can produce a vertical tension on the inflatable bag when it is actuated.

Another possibility for applying tension to the inflatable bag by means of a tension cable is given when the inflatable bag has a waist as a supporting element beneath its use area. If a tension cable is wrapped around this waist and then operated, it is again possible to create vertical tension forces.

Another design embodiment of the tension device is implementable in the form of a gear linkage. This gear linkage may be constructed in the manner of an umbrella-opening mechanism.

In order for the inflatable bag not to taper toward the lower end when tension is applied, it is advantageous if the inside surface of the inflatable bag can be supported in the lower area. Since the bottom construction is located in the lower area of the inflatable bag, it is advantageous from a design standpoint if this support is provided on an outside edge of the bottom construction. In order to prevent any possible damage to the inflatable bag or even to prevent it from tearing, it is advantageous if this outside edge of the bottom construction is provided with a radius.

The aforementioned design measures are very advantageous on the whole because they permit vertical tension on the inflatable bag with a short tension distance, in particular less than 20 millimeters. Therefore the mechanical complexity is low and therefore this is inexpensive.

Figure 2:
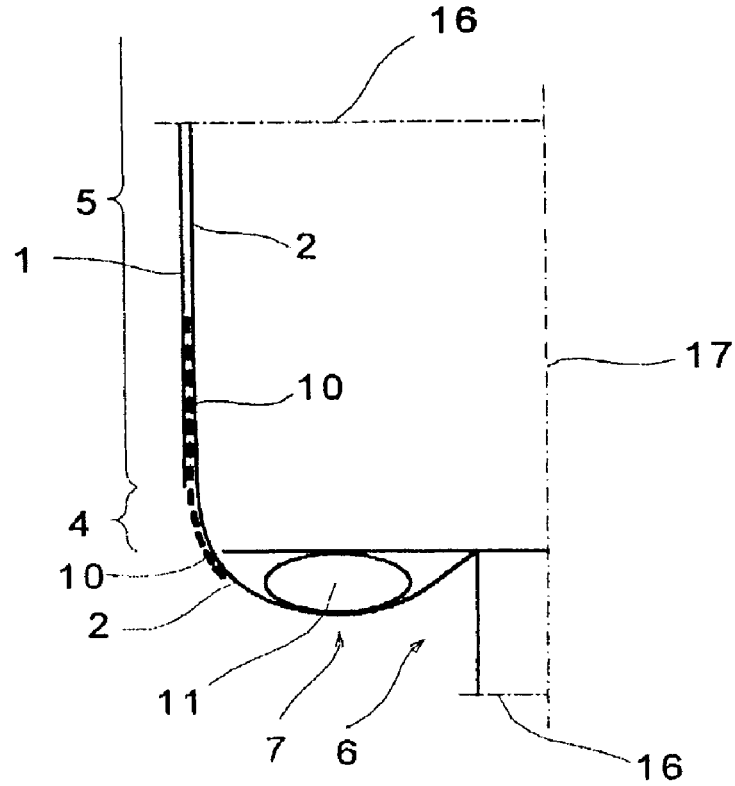
Figure 3:
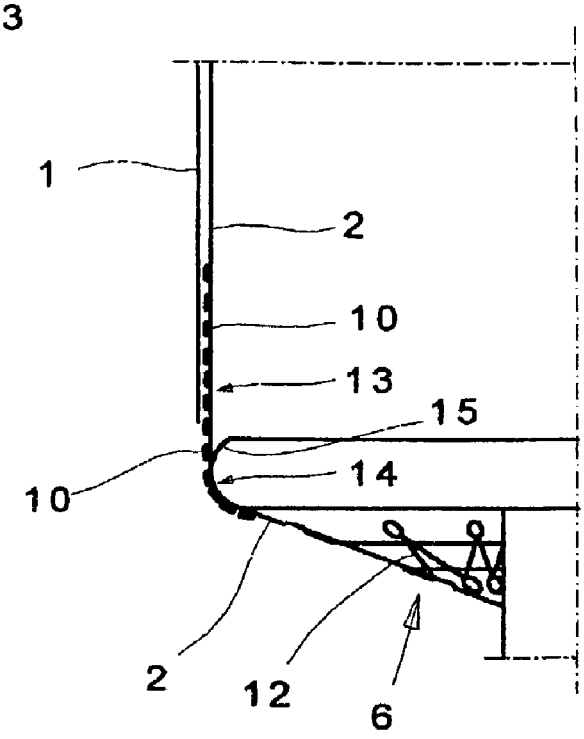
Figure 4:
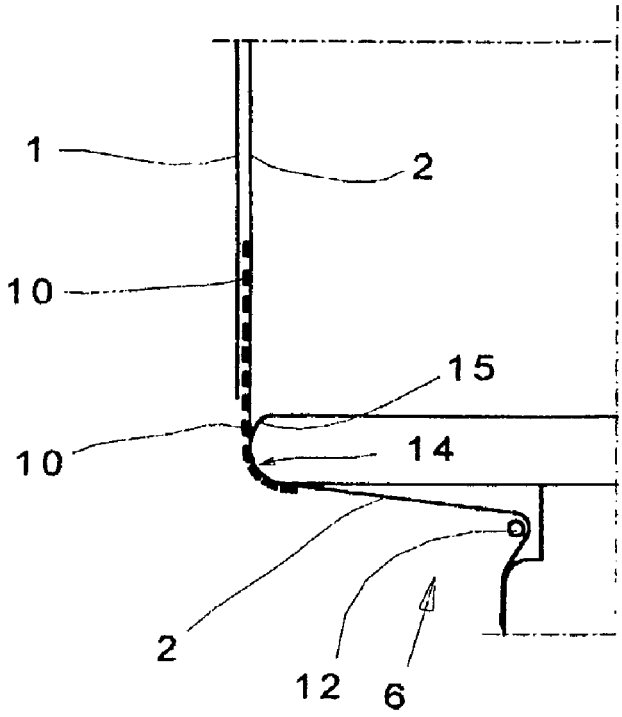

This invention will now be explained in greater detail on the basis of the figures, which show:

FIG. 1 a detail of a finisher without vertical tension on the inflatable bag on the part of an air cushion;

FIG. 2 a detail of a finisher having vertical tension on the inflatable bag by means of an air cushion;

FIG. 3 a detail of a finisher having vertical tension on the inflatable bag by means of a tension cable arranged in a star pattern;

FIG. 4 a detail of a finisher having vertical tension on the inflatable bag by means of a tension cable arranged in the form of a waist.

FIG. 1 shows a lower detail of a finisher 3. In addition, only half of this lower section is shown, as illustrated by a center line 17. Lines 16 represent perforation lines. A garment 1 is situated loosely on an inflatable bag 2. Inflatable bag 2 rests on a bottom construction 6, which forms the lower end of the finisher 3. The inflatable bag 2 has an area having a higher coefficient of friction 10 in a lower area 8 than in the upper area 9 of the inflatable bag 2. These areas 10 have been shown only for reasons of better recognizability and also in this exaggerated illustration with respect to the surface of the inflatable bag 2. A stream of air, which applies tension to the inflatable bag 2, is already active because this shows a bulge in the inflatable bag 2 beneath the lower hem in the garment 1. Garment 1 is situated on the inflatable bag and still has wrinkles. An air cushion 1, which is situated between parts of the inflatable bag 2 and a support of the bottom construction 6, is not yet inflated. This air cushion 1 represents a tension device 7 with which tension can be applied to the inflatable bag 2 so it can be stretched vertically upward. In order for there to be no wrinkles in garment 1, inflatable bag 2 must be stretched downward, i.e., air cushion 11 must be inflated. The surface of the inflatable bag 2 with its areas having a higher coefficient of friction 10 then entrain the lower end of clothing item 1 and also apply tension to it. Therefore, the wrinkles are stretched out of the clothing item and the stream of air thus produces a smooth surface on garment 1. FIG. 1 shows clearly that the areas with the higher coefficient of friction 10 cover a larger area than would be necessary for the current garment 1.

FIG. 2 shows the air cushion 11 in the inflated state. For reasons of uniformity and for a better overview, the same reference numbers used in FIG. 2 are also applicable to all the other figures and have the same meanings. An area 4, which is not covered by garment 1, has assumed the same shape due to the vertical tension on inflatable bag 2 as the area 5 of inflatable bag 2 covered by garment 1. The bulge shown in FIG. 1 is no longer discernable. The fact that the inflatable bag has in fact been put under tension can be seen by the fact that in comparison with FIG. 1 there are now areas with a higher coefficient of friction 10 below the upper contact surface of the air cushion 11. In order for the air cushion 11 to be able to function as a tension device 7, it is necessary for the inflatable bag 2 to be secured on the bottom construction 6. The distance of clothing item 1 from inflatable bag 2 shown here is not in fact the case but occurs only because the areas having the higher coefficient of friction 10, as already explained with regard to FIG. 1, have been exaggerated as to their thickness.

FIG. 3 shows another embodiment of the tension device 7. A tension cable 12 has been pulled through eyelets at the lower end of the inflatable bag 2 and through eyelets on the bottom construction 6. If the tension cable 12 is now put under tension, the inflatable bag is also put under vertical tension. The tension cable 12 can then be held in the taut position by means of clamping, for example. In order for the inside surface 13 of the inflatable bag 2 not to be damaged at the point where it is deflected around an outside edge 14 of the bottom construction 6, this outside edge 14 has been provided with a peripheral radius 15.

In the case of the exemplary embodiment in FIG. 4, a different possible application of the tension cable in vertical stretching of the inflatable bag is illustrated. The bottom construction 6 here has a peripheral waist in which both the lower end of the inflatable bag 2 as well as the tension cable are located. Beneath the waist the inflatable bag 2 is mounted on the bottom construction. Then when tension is applied to the tension cable 12, the inflatable bag 2 is constricted and is thus put under tension. Then the vertical tension of the inflatable bag 2 is in turn achieved through this tension.

| List of Reference Numbers | |
|---|---|
| 1 | garment |
| 2 | inflatable bag |
| 3 | finisher |
| 4 | surface of the inflatable bag not covered by the garment |
| 5 | surface of the inflatable bag covered by the garment |
| 6 | bottom construction |
| 7 | tension device |
| 8 | lower area of the inflatable bag |
| 9 | upper area of the inflatable bag |
| 10 | area having a higher coefficient of friction |
| 11 | air cushion |
| 12 | tension cable |
| 13 | inside surface of the inflatable bag |
| 14 | outside edge of the bottom construction |
| 15 | radius |
| 16 | perforation line |
| 17 | center line |

The invention claimed is:

1. A device for ironing garments, comprising:

a finisher including an inflatable bag to accommodate the garments;

a bottom construction provided at a lower end of said inflatable bag;

said inflatable bag having an outside surface with an upper and a lower area and said lower area surface having a first coefficient of friction being higher than said upper area surface coefficient of friction; and a tension device arranged between said bottom construction and said inflatable bag for applying vertical tension to said inflatable bag, the lower area surface gripping the garment and pulling the garment in a vertically downward direction in response to the vertical tension of the tension device and stretching the lower end of the garment, the upper area surface permitting the garment to slide over the inflatable bag.

2. The device according to claim 1, including said inflatable bag generally shaped as a human upper body adapted for ironing garments, including shirts, blouses, T-shirts and jackets.

3. The device according to claim 1, including said lower area surface being about one quarter of the length of said inflatable bag.

4. The device according claim 1, including said lower area surface including at least some portions having a second coefficient of friction higher than said first coefficient of friction.

5. The device according to claim 1, including said lower area surface first higher coefficient of friction including a rubberized surface forming said higher coefficient of friction.

6. The device according to claim 1, including said lower area surface first higher coefficient of friction including chemical adhesives on said surface forming said higher coefficient of friction.

7. The device according to claim 1, including said lower area surface first higher coefficient of friction including a hook and loop fastener structure forming said higher coefficient of friction.

8. The device according to claim 1, including said lower end of said inflatable bag including an inside surface and said bottom construction including an outside edge in contact with said inflatable bag inside surface.

9. The device according to claim 8, including said bottom construction outside edge having a radius.

10. The device according to claim 1, including said tension device arranged between said bottom construction and said inflatable bag for applying vertical tension to said inflatable bag including a tension path on the order of about twenty millimeters.

11. A method for ironing garments, including a finisher having an inflatable bag to accommodate the garments and a bottom construction provided at a lower end of the inflatable bag, comprising:

providing a tension device between said bottom construction and said inflatable bag and applying vertical tension to said inflatable bag, said tension device including one of an inflatable cushion and a tension cable, said inflatable bag having an outside surface with an upper and a lower area and forming said lower area surface with a first higher coefficient of friction than said upper area surface coefficient of friction; and gripping the garment with the lower surface area and pulling the garment in a vertically downward in response to the vertical tension applied by the tension device and stretching the lower end of the garment, the upper area surface permitting the garment to slide over the inflatable bag.

12. The method according to claim 11, including forming said lower area surface about one quarter of the length of said inflatable bag.

13. The method according to claim 11, including forming said lower area surface with at least some portions having a second coefficient of friction higher than said first coefficient of friction.

14. The method according to claim 11, including rubberizing said lower area surface to form said first higher coefficient of friction.

15. The method according to claim 11, including securing chemical adhesives on said lower area surface to form said first higher coefficient of friction.

16. The method according to claim 11, including forming said lower area surface first higher coefficient of friction by securing a hook and loop fastener structure on said lower area surface to form said higher coefficient of friction.

17. The method according to claim 11, including said lower end of said inflatable bag including an inside surface and said bottom construction including an outside edge and contacting said outside edge with said inflatable bag inside surface.

18. The method according to claim 17, including forming a radius on said bottom construction outside edge.

19. A device for ironing garments, comprising:

a flexible inflatable bag receiving garments and defining an outer surface and including a lower area surface having a first coefficient of friction and an upper area surface positioned above the lower area surface and having a second coefficient of friction, the first coefficient of friction being higher than the second coefficient of friction, the bag including a substantially cylindrical torso section and having a center line extending through the bag and defining an axial direction;

a bottom portion supporting the inflatable bag and disposed adjacent the lower area of the inflatable bag, the bottom portion being fixed and the bag being movable with respect to the bottom portion; and a tension device disposed below the bottom construction and being connected to the bottom construction and the inflatable bag, the tension device applying a vertical tension to the inflatable bag and the bag being moved in the axial direction beyond the bottom portion in response to the vertical tension applied by the tension device, the lower area gripping the garment and pulling the garment in the axial direction in response to the vertical tension of the tension device and stretching the lower end of the garment, the upper area permitting the garment to slide over the inflatable bag.

20. The device according to claim 19, wherein the tension device includes an inflatable air cushion having an upper edge connected to the bottom portion and a lower edge engaging the inflatable bag, the inflatable bag being connected to the bottom portion, the air cushion having a deflated condition, in which the air cushion is contracted and the lower edge is positioned near the bottom portion, and an inflated condition, in which the air cushion is expanded to move the lower edge and the inflatable bag away from the bottom portion in the axial direction.

* * * * *